United States Patent [19]

Allinder

[11] Patent Number: 5,035,523

[45] Date of Patent: Jul. 30, 1991

[54] MULTIPURPOSE BELT

[76] Inventor: Michael F. Allinder, Rte. 4, Box 1442, Palatka, Fla. 32177

[21] Appl. No.: 525,912

[22] Filed: May 21, 1990

[51] Int. Cl.[5] ..... A46B 5/02; B05B 1/00; A47K 7/02

[52] U.S. Cl. ..... 401/6; 401/8; 15/222; 15/104.94; 15/118; 224/229; 224/224

[58] Field of Search ..... 401/6-8, 401/201; 15/104.94, 118, 209 R, 222; 224/229, 224, 228, 227, 226, 225; D2/630; D3/106, 104, 100, 101

[56] References Cited

U.S. PATENT DOCUMENTS

| | | | |
|---|---|---|---|
| D. 258,246 | 2/1981 | Kravchenko | D2/630 |
| D. 261,196 | 10/1981 | Griffin | 224/229 X |
| D. 277,810 | 3/1985 | Pickens | D2/630 |
| 367,996 | 8/1887 | Nathan | D2/630 X |
| 1,600,027 | 9/1926 | Welsand | 224/224 X |
| 3,959,841 | 6/1976 | Horne | 401/8 X |
| 3,977,796 | 8/1976 | Gillespie et al. | 401/8 |
| 4,187,575 | 2/1980 | Collins | 401/8 X |
| 4,196,490 | 4/1980 | Jonzon | 401/8 X |
| 4,698,854 | 10/1987 | Slimmon | 15/222 X |

*Primary Examiner*—Danton D. DeMille
*Attorney, Agent, or Firm*—MacDonald J. Wiggins

[57] ABSTRACT

A combination belt and lotion applicator includes a nylon strap having a circular handle attached to each end. A removable absorbent pad includes a hook type fastener on one surface thereof. A matching loop fastener is attached to a central portion of the strap to permit the pad to be attached and removed. A plurality of pockets with slide fasteners is disposed on the outer surface of the strap. The handles have a buckle attached thereto to permit the strap to be fastened around the waist of user. When the belt is unbuckled, loyion may be applied to the pad, and applied to the user's back by holding a handle in each hand.

15 Claims, 1 Drawing Sheet

MULTIPURPOSE BELT

BACKGROUND OF THE INVENTION

1. Field of the Invention

The present invention relates to multipurpose belts, and more particularly to a belt for applying lotion to the back, for attachment around the waist, and for temporarily storing small objects, and which is suitable for use at beaches and the like.

2. Description of the Prior Art

It is common to apply lotions, such as suntan cremes and protective lotions, when at beaches, swimming pools or engaging in sunbathing. It is difficult for an individual to apply such lotions to his back area. Another problem in such circumstances is the storage of keys, money, identification cards, and the like when a person is clad only in swim apparel.

An attempt has been made in the prior art to solve these problems individually. For example, containers for small personal items with means for attaching to the wrist or around the neck are known. Jonzon, in U.S. Pat. No. 4,196,490 shows a strap having handles and a sponge pad for scrubbing the back. Gillespie et al., U.S. Pat. No. 3,977,796 teach a similar strap having a pocket for soap. A lotion applicator is disclosed by Sage, U.S. Pat. No. 3,870,419. Other designs for back scrubbers appear in the following U.S. Pats.: No. 3,791,746 to Yerka; No. 3,674,374 to Jennings; and No. 3,024,486 to Naugle.

There is need for multipurpose device than can be worn around the waist to hold personal items, and which is removable to permit attachment of a pad to apply lotions, or the like, to hard-to-reach areas of the user's body.

SUMMARY OF THE INVENTION

The present invention includes a wide belt, fabricated from a nylon fabric or the like, and having a ring attached to each end thereof. The rings act as handles and include a buckling device, permitting the belt to be fastened around the waist. A plurality of pockets is formed, or attached to the outer surface of the belt, and include closures, such as slide fasteners, for holding small personal items.

At the center area of the inner surface of the belt, a thin pad of absorbent material, such as sponge, is attached. The attachment of the pad may be temporary, using hook and loop fastening material, to permit interchangeable pads to be used.

As will be understood, a lotion may be applied to the surface of a pad, and transferred to the back area of the user by holding a handle ring in each hand, and moving the pad against the user's back area. After such application, the user may buckle the belt around the waist until needed again.

Other types of pads, such as sponge, may be used for washing the back when bathing, and a textured rubber pad may be used for massaging the back.

A clip may be provided into which a lotion bottle or the like may fit. The belt may include a socket to accept the clip, thereby providing a convenient means for carrying the lotion bottle.

It is therefore a principal object of the invention to provide a multipurpose belt that provides means for applying lotions, or the like, to hard-to-reach parts of the body, provides pockets for holding small personal items, and that can be worn as a belt.

It is another object of the invention to provide a belt having a pair of handles and interchangeable pads attachable to a central surface of the belt, and in which the handles include buckling means for permitting the belt to be worn around the waist.

These and other objects and advantages will become apparent from the following detailed description when read in conjunction with the drawings.

DETAILED DESCRIPTION OF THE PREFERRED EMBODIMENT

Figure 1:
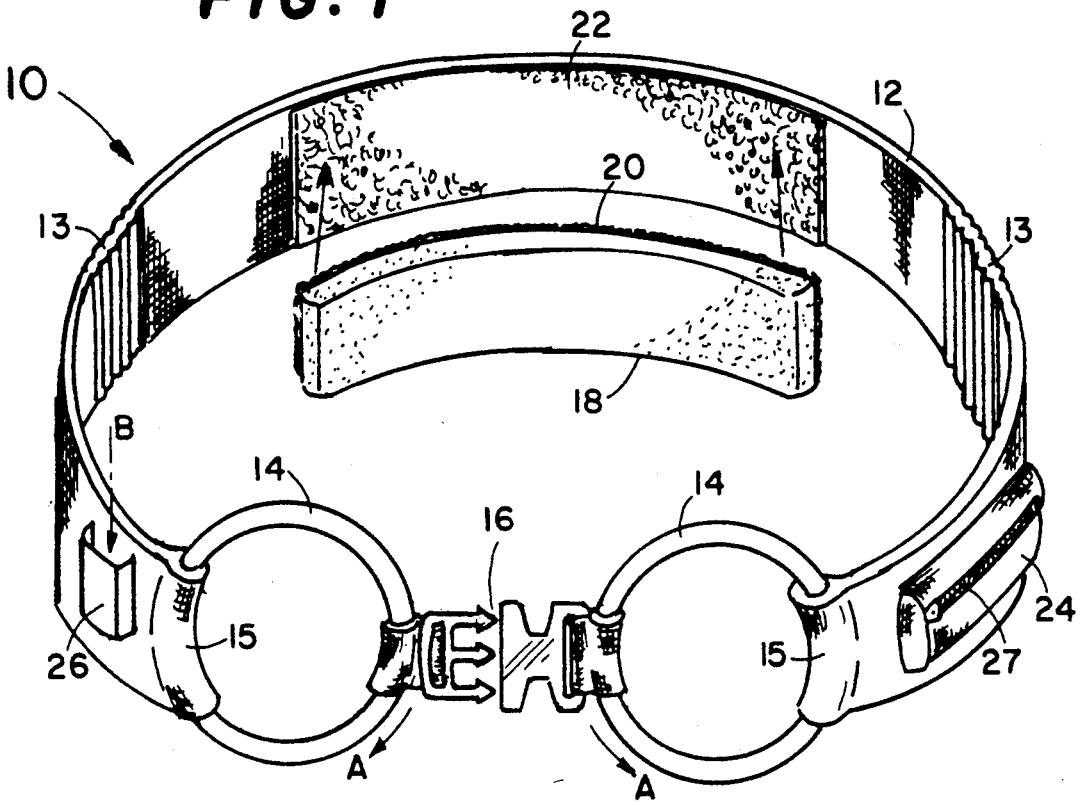
FIG. 1 is a perspective front view of the belt of the invention showing a removable pad.

Referring to FIG. 1, a preferred embodiment of the multipurpose belt 10 of the invention is shown. A strap 12 forms the body encircling portion of belt 10, and is preferably made of a waterproof, lightweight fabric, such as nylon. Preferably, strap 12 is reinforced with a suitable interfacing. A ring 14 is attached to each end 15 of strap 12, and serve as handles as discussed hereinbelow. Rings 14 are preferable of a soft, resilient plastic material, or may be formed from surgical rubber tubing or the like. Buckle means 16 are used to fasten rings 14 together to permit belt 10 to be worn around a user's waist. A buckle 16 of the design shown is preferred, and is formed from a waterproof material that is not affected by the elements.

It is required, in one aspect of the invention, to provide an applicator pad 18 to an inner surface of belt 10. Although pad 18 may be permanently attached to belt 10 by an adhesive, or by sewing, it is preferred that pad 18 be removable. This feature advantageously permits various types and textures of pads to be used, and permits a pad to be removed for cleaning. To this end, a means for temporarily attaching pad 18 is provided. The preferred means is a hook and loop fastener having loop material 22 permanently attached to the central inner surface of strap 12, and hook material 20 attached to the rear surface of pad 18. The use of the soft loop material 22 permits belt 10 to be worn as a belt with the loop material 22 against bare skin without discomfort.

Pad 18 may be formed of any material suitable for the intended use. For applying lotion, salves, and the like, plastic or rubber foam, or adsorbent cloth materials are suitable. For bathing purposes, pad 18 may use sponge type material.

Figure 2:
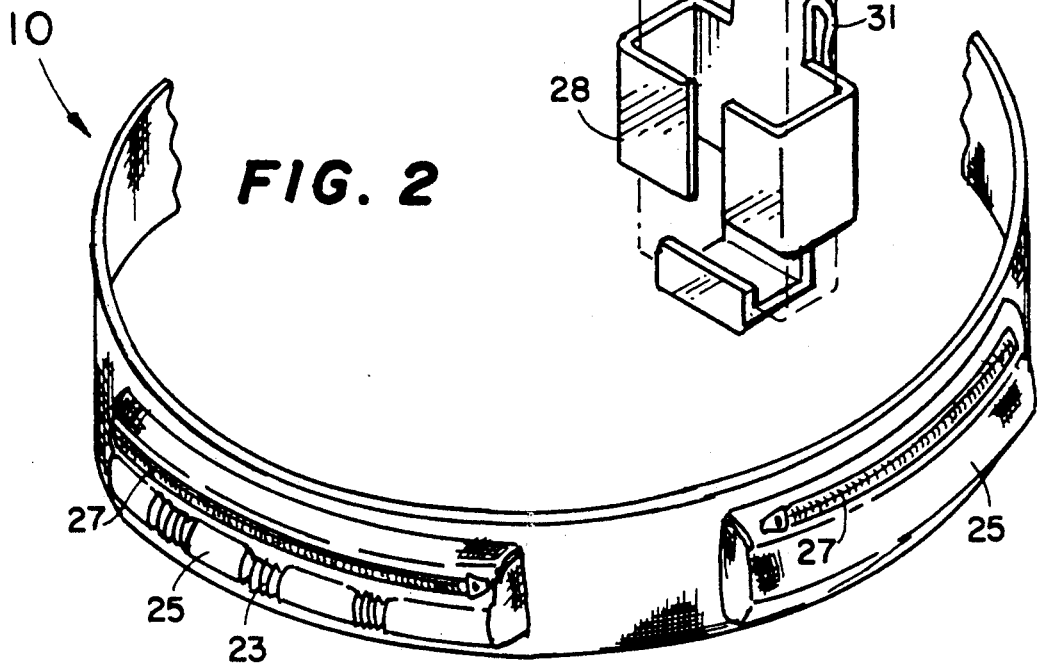
FIG. 2 is a rear partial view of the belt of FIG. 1 showing article-holding pockets.

FIG. 1 shows a pocket 24 attached to an outer surface of belt 10 adjacent buckle 16, and FIG. 2 illustrates a rear view of belt 10 with pockets 25. Any suitable closure may be used for the flaps of pockets 24 and 25, although plastic side closures 27 are preferred. Pockets 24 and 25 may include pleats 23 which permit a pocket to expand when required.

Figure 3:
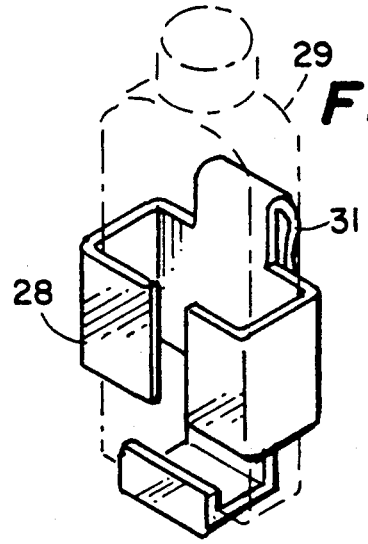
FIG. 3 is a perspective view of clip for holding a small bottle attachable to the belt of FIG. 1.

Turning to FIG. 3, a plastic holder 28 having a clip 31 is shown which is formed to hold a small bottle 29 (shown in phantom view), such as a lotion bottle. When the bottle is not in use, clip 31 may engage pocket 26 on belt 10 of FIG. 1 as indicated by arrow B, thus permitting the user to carry bottle 29 for easy access.

When a user wishes to apply a lotion, belt 10 is opened, as in FIG. 1 and buckle elements moved along rings 14 as indicated by arrows A to contact strap ends 15., permitting rings 14 to be used as handles. A suitable pad 18 is selected, and attached to strap 12 by hook and loop materials 20, 22. The desired lotion is spread on pad 18, and handle rings 14 grasped to place pad 18 against the user's back area. The belt 10 is moved to apply lotions desired. After application is complete, buckle elements 16 are moved to the position shown, pad 18 removed, and belt 10 buckled around the user's waist.

The belt 10 may be made in a range of belt sizes, as is conventional. Where handle rings 14 are resilient, some stretching permits one size to fit a range of waist sizes. To minimize the number of sizes, elastic sections 13 may be included in strap 12, although a one-piece strap 12 is preferred.

As will now be recognized, a multipurpose belt has been disclosed that provides convenience to swimmers and sunbathers. Such persons may utilize the invention to apply lotions to hard-to-reach areas of their bodies, or to scrub such areas, and to store and carry personal items such as keys, money, cards, and the like. Additionally, small containers of lotion may be carried and ready for frequent application.

Although a specific design of the invention has been disclosed for exemplary purposes, various changes in materials and arrangements may be made without departing from the spirit and scope of the invention.

I claim:

1. A belt for holding and carrying objects, and for applying lotion and the like to the body of a user, comprising:

a strap for encircling a user's body for wearing as a belt;

a pair of handle rings, said rings attached to respective ends of said strap;

buckle means movably attached to said pair of rings for securing said strap around a user's body;

a resilient pad for holding lotion and the like, said pad attachable to a rear surface of said strap; and at least one pocket attached to an outer surface of said strap for holding and carrying objects.

2. The belt as defined in claim 1 in which said pocket includes a closure means.

3. The belt as defined in claim 2 in which said closure means is a slide fastener.

4. The belt as defined in claim 2 which includes a flap-type cover.

5. The belt as defined in claim 1 which further includes an open-topped pocket for accepting a bottle holder having a pocket-engaging clip.

6. The belt as defined in claim 1 in which said pad is attached to said strap by hook and loop fastening material.

7. The belt as defined in claim 1 in which said belt is formed of nylon.

8. A combination belt and lotion applicator comprising;

an elongate flat strap;

a pair of handle rings each handle attached to each end of said strap;

a buckle device having a first portion attached to a first of said handles, and a second portion attached to a second of said handles to permit fastening of said strap around a user's body to form a belt;

an applicator pad for holding lotion or the like having hook fastener material attached to a surface thereof;

a loop fastener material attached to a central area of a first surface of said strap for accepting said pad; and a plurality of pockets attached to a second surface of said strap;

whereby a user may use said strap, when unbuckled, for applying lotion or the like to the back by holding a handle in each hand.

9. The belt and applicator as defined in claim 8 in which said pockets include a closure means.

10. The belt and applicator as defined in claim 9 in which said closure means is a slide fastener.

11. The belt and applicator as defined in claim 9 which further includes an open-topped pocket for accepting a bottle holder having a pocket-engaging clip.

12. The belt and applicator as defined in claim 9 in which each of said handle rings handles is a flexible ring.

13. The belt and applicator as defined in claim 12 in which said buckle portions are movably attached to respective ones of said rings.

14. The belt and applicator as defined in claim 8 in which said belt is formed of nylon.

15. The belt and applicator as defined in claim 8 in which said pockets are expandable.

* * * * *